US010781386B2

(12) United States Patent
Kar et al.

(10) Patent No.: US 10,781,386 B2
(45) Date of Patent: Sep. 22, 2020

(54) CETANE IMPROVER IN FUEL OIL

(71) Applicant: ExxonMobil Research and Engineering Company, Annandale, NJ (US)

(72) Inventors: Kenneth C. H. Kar, Philadelphia, PA (US); Sheryl B. Rubin-Pitel, Newtown, PA (US); David T. Ferrughelli, Easton, PA (US); Anthony S. Mennito, Flemington, NJ (US); Teng Xu, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 92 days.

(21) Appl. No.: 16/162,859

(22) Filed: Oct. 17, 2018

(65) Prior Publication Data

US 2019/0127651 A1 May 2, 2019

Related U.S. Application Data

(60) Provisional application No. 62/580,478, filed on Nov. 2, 2017.

(51) Int. Cl.
*C10L 1/23* (2006.01)
*C10L 1/18* (2006.01)
(Continued)

(52) U.S. Cl.
CPC ..... *C10L 1/231* (2013.01); *C10L 1/08* (2013.01); *C10L 1/1811* (2013.01); *C10L 10/12* (2013.01);
(Continued)

(58) Field of Classification Search
CPC combination set(s) only.
See application file for complete search history.

(56) References Cited

U.S. PATENT DOCUMENTS 5,389,111 A 2/1995 Nikanjam et al.
5,389,112 A 2/1995 Nikanjam et al.
(Continued)

FOREIGN PATENT DOCUMENTS

EP 157684 A1 10/1985
EP 0457589 A1 11/1991

OTHER PUBLICATIONS

Karonis et al: "A multivariate statistical analysis to evaluate and predict ignition quality of marine diesel fuel distillates from their physical properties", Fuel Processing Technology, Elsevier BV, NL, vol. 166, Jun. 21, 2017 (Jun. 21, 2017), pp. 299-311 (Year: 2017).*
(Continued)

*Primary Examiner* — Ellen M McAvoy
*Assistant Examiner* — Chantel L Graham
(74) *Attorney, Agent, or Firm* — Robert A. Migliorini

(57) ABSTRACT

Marine fuel oil compositions are provided that exhibit unexpectedly high cetane numbers after addition of a cetane improver. Methods of making such compositions are also provided. The unexpected nature of the marine fuel oil compositions is based in part on the ability to achieve a substantial improvement in estimated cetane number by addition of a cetane improver to a hydrocarbonaceous composition with a natural estimated cetane number of less than 35. These unexpectedly high increases in estimated cetane number for fuels or fuel blending components with low natural estimated cetane numbers can allow for production of fuel compositions with desirable combustion characteristics while also maintaining a higher level of aromatic compounds and/or reducing or minimizing the amount of
(Continued)

distillate boiling range components in the fuel or fuel blending component.

19 Claims, 4 Drawing Sheets

(51) Int. Cl.
*C10L 10/12* (2006.01)
*C10L 1/08* (2006.01)

(52) U.S. Cl.
CPC . *C10G 2300/307* (2013.01); *C10G 2300/308* (2013.01); *C10G 2400/04* (2013.01); *C10L 2200/0438* (2013.01); *C10L 2200/0453* (2013.01); *C10L 2270/026* (2013.01)

(56) References Cited

U.S. PATENT DOCUMENTS

| | | | | |
|---|---|---|---|---|
| 5,792,339 | A | 8/1998 | Russell | |
| 5,871,634 | A | 2/1999 | Wiehe et al. | |
| 2003/0110684 | A1 | 6/2003 | Henly | |
| 2017/0002273 | A1* | 1/2017 | Rubin-Pitel | C10G 47/02 |

OTHER PUBLICATIONS

Vermeire: "Everything You Need to Know About Marine Fuels", Jun. 30, 2012 (Jun. 30, 2012) (Year: 2012).*

Diesel Fuels Technical Review, 2007, Chevron Corporation. Accessed fro the internet on Oct. 1, 2018, https://www.chevron.com/-/media/chevron/operations/documents/diesel-fuel-tech-review.pdf.

Berkhous, "Using a constant volume combustion chamber analyzer for predicting derived cetane number of aviation turbine fuels", presentation at the 11th International Conference on Stability, Handling and use of Liquid Fuels, 2009.

The International Search Report and Written Opinion of PCT/US2018/056241 dated Jan. 7, 2019.

Karonis et al., "A multivariate statistical analysis to evaluate and predict ignition quality of marine diesel fuel distillates from their physical properties", Fuel Processing Technology 166 (2017) 299-311.

Vermeire, "Everything you need to know about marine fuels", Retrieved from the internet: URL:https://www.chevronmarineproducts.com/content/dam/chevron-marine/Brochures/Chevron_EverythingYouNeeToKnowAboutFuels_v3_1a_Desktop.pdf [retrieved on Dec. 21, 2018].

Speight (2016) Introduction to Enhanced Recovery Methods for Heavy Oil and Tar Sands (Second Edition)), pp. 210, Chapter 5.4.1, pp. 210.

* cited by examiner

CETANE IMPROVER IN FUEL OIL

CROSS-REFERENCE TO RELATED APPLICATIONS

This Application claims priority to U.S. Provisional Application Ser. No. 62/580,478 filed Nov. 2, 2017, which is herein incorporated by reference in its entirety.

FIELD

The invention relates to marine fuel oil compositions that include a cetane improver and methods for making such fuel oil compositions.

BACKGROUND

Marine fuel oil, sometimes referred to as bunker fuel, has traditionally provided a use for heavy oil fractions that are otherwise difficult and/or expensive to convert to a beneficial use. Due in part to a relatively high sulfur limit in international waters, vacuum resid fractions as well as other lightly processed (or even unprocessed) fractions can be incorporated into traditional fuel oils. However, various local and international specifications are becoming more stringent in the near future. Currently, few options are available that satisfy the requirements of ISO 8217, Table 2 with regard to low sulfur fuel oil (LSFO) or an ultra low sulfur fuel oil (ULSFO). If more options are not developed, the increasingly stringent regulations may force marine vessels to switch to higher cost marine diesel fuels (ISO 8217, Table 1). As a result, the development of additional methods for producing lower sulfur fuel oils and/or marine gas oils will become increasingly important.

One option for upgrading heavy fractions to higher value products is to expose a fraction to cracking conditions and/or other severe conditions. While this can lead to reduced sulfur content, the resulting products typically correspond to highly aromatic and/or cracked fractions. Such fractions can have relatively poor combustion characteristics.

A typical solution for improving the combustion characteristics of a potential marine fuel oil can be to blend a cracked/aromatic fraction with a distillate fraction. This can improve the combustion characteristics, but the resulting blends can also suffer from incompatibility depending on the nature of the cracked/aromatic fraction and the amount of distillate in the blend. Incompatibility can cause precipitation of solids, which can potentially lead to clogging of fuel filters. Additionally, use of distillate fractions to form marine fuels often corresponds to "downgrading" of a more valuable distillate fraction into a lower value product. Thus, it would be beneficial to have the ability to reduce or minimize the amount of higher value distillate fractions that are required to form a marine fuel.

Another option for reducing sulfur levels and/or improving combustion properties can be to blend a heavy aromatic/cracked fraction with a paraffinic blendstock, such as certain types of conventional ultra low sulfur fuel oil (ULSFO). Unfortunately, conventional ULSFOs can tend to be paraffinic in nature, which can also cause incompatibility problems when blended with aromatic/cracked fractions. Thus, it would be desirable to develop methods and compositions that can reduce or minimize the amount of distillate and/or conventional ultra low sulfur fuel oil that is needed in order to generate a marine fuel oil with desirable combustion properties.

U.S. Patent Application Publication 2003/0110684 is an example of a diesel fuel composition that includes an organic nitrate as an additive that corresponds to a cetane improver. Generally, it is understood that cetane improvers can be effective for improving the cetane number of a distillate fuel, so long as the cetane number of the fuel without the cetane improver additive is sufficiently high, such as having a cetane number prior to addition of cetane improver of 40 or greater, or possibly 35 or greater.

Additional explanation regarding the conventional understanding of cetane improvers is provided in a Diesel Fuels Technical Review (2007) document available from Chevron Corporation. As explained in the Diesel Fuels Technical Review, the amount of improvement in cetane number for a diesel fuel is conventionally between 3 and 8 numbers, depending on the nature of the distillate fuel and the amount of cetane improver that is added. It is further explained that the amount of benefit from a cetane improver is generally greater for fuel that already has a high cetane number. Conventional amounts of cetane improver that are considered as beneficial for use as an additive are 0.05 wt % (500 vppm) to 0.4 wt % (4000 vppm).

A journal article by S. Berkhous from the 11$^{th}$ International Conference on the Stability, Handling, and Use of Liquid Fuels provides additional explanation for why cetane improvers are conventionally used in amounts of ~5000 vppm or less. As shown in the Berkhous journal article, the benefit of using a cetane improver generally decreases as the amount of the cetane improver additive is increased.

SUMMARY

In various aspects, a marine fuel oil composition is provided. The marine fuel oil composition can include an estimated cetane number (according to IP541) of 35 or less, or 30 or less, and at least 200 vppm of a cetane improver relative to a volume of the marine fuel oil composition. The marine fuel oil composition can further include one or more of the following properties, such as at least two, or at least three, or all of the following properties: a) a BMCI of 50 or more; b) a CCAI of 820 or more; c) a density of 0.90 g/cm$^3$ or more at 15° C.; d) a T90 distillation point of at least 450° C. Optionally, the amount of cetane improver can correspond to 500 vppm or more, or 1000 vppm or more, or 2000 vppm or more, such as up to 10,000 vppm or possibly still higher. In some aspects, the cetane improver can correspond to an organic nitrate, a peroxide, or a combination thereof.

In various aspects, a method for forming a marine fuel oil composition is provided. The method can include adding at least 200 vppm of a cetane improver to a fuel composition comprising an estimated cetane number (based on IP541) of less than 30, or less than 25. The fuel composition can further include one or more of the following properties, such as at least two, or at least three, or all of the following properties: a) a BMCI of 50 or more; b) a CCAI of 820 or more; c) a density of 0.90 g/cm$^3$ or more at 15° C.; d) a T90 distillation point of at least 450° C. Optionally but preferably, the resulting marine fuel oil composition can include an estimated cetane number (based on IP541) of 35 or less, or 30 or less. Optionally, the amount of cetane improver can correspond to 500 vppm or more, or 1000 vppm or more, or 2000 vppm or more, such as up to 10,000 vppm or possibly still higher. In some aspects, the cetane improver can correspond to an organic nitrate, a peroxide, or a combination thereof.

In some aspects, the marine fuel oil composition can include a sulfur content of 0.5 wt % or less and/or a sulfur content of 0.05 wt % or more. Additionally or alternately, the marine fuel oil composition can have a kinematic viscosity at 50° C. (KV50) of at least 15 cSt and/or a kinematic viscosity at 100° C. of at least 4 cSt. Additionally or alternately, the marine fuel oil composition can have an insolubility number of 30 or more and/or a solubility number of 60 or more. Additionally or alternately, the marine fuel oil composition can include a micro carbon residue content of 2.0 wt % or more and/or an asphaltenes content of 1.0 wt % or more.

In some aspects, the marine fuel oil composition can include 40 wt % or more of aromatics, such as 60 wt % or more, or 80 wt % or more. In some aspects, the marine fuel oil composition can include 20 wt % or less of n-paraffins, such as 10 wt % or less).

DETAILED DESCRIPTION

Overview

Figure 1:
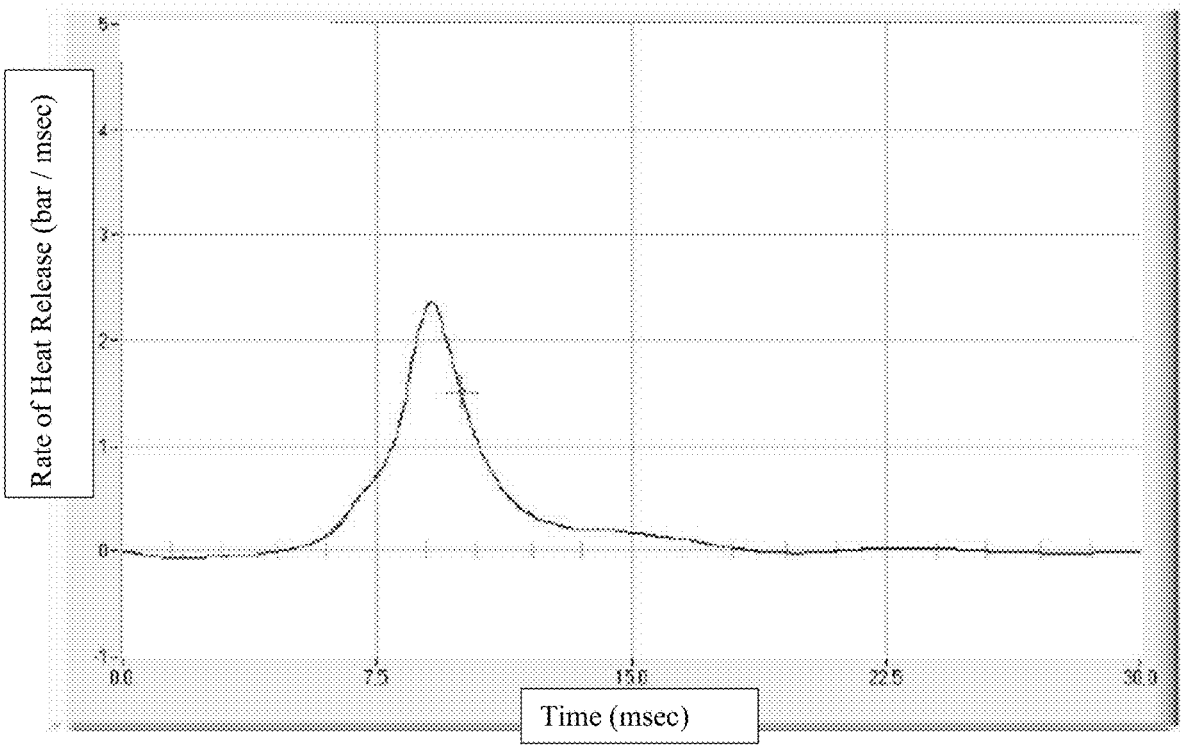
FIG. 1 shows a rate of heat release curve for a potential fuel oil or fuel oil blend component that does not contain a cetane improver.

In various aspects, marine fuel oil compositions are provided that exhibit unexpectedly high cetane numbers (such as estimated cetane numbers) after addition of a cetane improver. Methods of making such compositions are also provided. The unexpected nature of the marine fuel oil compositions is based in part on the ability to achieve a substantial improvement in estimated cetane number by addition of a cetane improver to a hydrocarbonaceous composition (such as an initial fuel or fuel blending component) with a low natural estimated cetane number of less than 35, or less than 30, or less than 25, or less than 20. Additionally or alternately, further unexpected benefit is achieved when adding 1000 vppm or more (or 2000 vppm or more) of a cetane improver to a fuel or fuel blending component (or other hydrocarbonaceous composition) having a low natural estimated cetane number. Instead of the expected reduction in benefit when adding elevated amounts of cetane improver, some fuel to compositions described herein can achieve improvements in estimated cetane number that are greater than the increases that can conventionally be achieved with a high cetane number diesel fuel. These unexpectedly high increases in estimated cetane number for fuels or fuel blending components with low natural estimated cetane numbers can allow for production of fuel compositions with desirable combustion characteristics while also maintaining a higher level of aromatic compounds and/or reducing or minimizing the amount of distillate boiling range components in the fuel or fuel blending component.

Cetane improvers are conventionally used to improve the cetane number of a variety of distillate fuels. Examples of conventional cetane improver additives include, but are not limited to, organic nitrates (such as 2-ethylhexyl nitrate), peroxides (such as di-tert butyl peroxide), and some nitroso compounds. Addition of ~500 vppm to 5000 vppm of a conventional cetane improver can produce an increase in cetane number of 3 to 8 for fuels with a sufficiently high natural cetane number, such as a natural cetane number of at least 40.

Conventionally, cetane improvers are not used as additives for marine fuel oils. This is due in part to the long understood conventional wisdom that cetane improvers have reduced or minimized effectiveness for fuels with low natural cetane numbers. Typically the lower threshold for conventional use of a cetane improver additive is having a fuel with a natural cetane number of at least 40 as a starting point, or possibly at least 35. In this discussion, the "natural" cetane number of a fuel or fuel blend component refers to the cetane number of the fuel prior to the addition of a conventional cetane improver. It is noted that the natural cetane number for a fuel or fuel blend component can also be referred to as a "clear" cetane number. In contrast to distillate fuels, the natural cetane number for resid fractions and/or aromatic fractions that are desired for use in a fuel oil can be substantially lower, such as 30 or less, or 25 or less, or 20 or less, or possibly still lower. In some aspects, the cetane number of a heavy and/or aromatic fraction may be near 0, so that blending with a portion of a high cetane distillate fuel blend component results in a blended product with a natural cetane number of 30 or less, or 25 or less, or 20 or less. In various aspects, based on a goal of producing a marine fuel oil having desirable combustion characteristics, a marine fuel oil or blend component (such as a blended product containing both resid and distillate fractions) can have a natural cetane number of at least 5, or at least 10. For example, a marine fuel oil or blend component suitable for addition of a cetane improver can have a natural cetane number of 5 to 30, or 10 to 30, or 5 to 20, or 10 to 25. The amount of cetane improver added to the marine fuel oil or blend component can correspond to 200 vppm to 10,000 vppm, or 200 vppm to 5000 vppm, or 500 vppm to 5000 vppm, or 1000 vppm to 10,000 vppm, or 1000 vppm to 5000 vppm, or 2000 vppm to 10,000 vppm, or 2000 vppm to 5000 vppm.

The unexpected finding that cetane improvers can be used to substantially improve the combustion quality of marine fuel oils can allow for production of marine fuel oil compositions with a variety of potential advantages. In some aspects, marine fuel oils including a cetane improver can have a sufficiently high cetane number (such as an estimated cetane number) while having an increased content of aromatics. Currently available ULSFOs can tend to be more paraffinic and contain no asphaltenes. The increased paraffinic content can improve the cetane value of such ULSFOs. However, such conventional ULSFOs can have low BMCI values, indicating a lower compatibility with other residual fuel oils and higher risk of wax precipitation causing filter blocking in the fuel system. The ability to introduce more aromatic blendstock into ULSFO products by using a cetane improver can allow for improved compatibility while reducing or minimizing any deterioration in ignition and combustion quality. Additionally or alternately, the higher the aromatic content of a fuel, the higher the volumetric energy density of a fuel will typically be. The unexpected benefits found in use of cetane improver in a marine fuel oil can allow for production of a fuel with an increased energy density and yet good ignition and combustion quality.

Use of cetane improver in marine fuel oil can also expand the options available for refineries when attempting to form suitable blends to form a marine fuel oil. Fuel oil blending typically involves blending residual materials with a distillate to correct for density, viscosity, sulfur content, calculated carbon aromaticity index (CCAI) and/or pour point. Since correction is solely achieved conventionally by distillate blending, a blendstock with desirable properties is required, which ultimately depends on the availability of blend stocks. The use of cetane improver provides an extra degree of freedom in fuel oil blending, enabling blendstocks with high aromaticity/poorer combustion quality to be used for fuel oil blending. Alternatively, residual materials with high aromaticity/poorer combustion quality can be blended with typical distillate without adjustment in blend ratios and/or without requiring blending of additional distillates to the point where the resulting blend may become incompatible.

As an example, hydroprocessing of hydrocarbon bottoms (e.g. pyrolysis tar) can upgrade a low value material to a high value fuel or fuel blendstock for blending in LSFO or ULSFO. Hydroprocessed hydrocarbon bottoms can have unusual compositions compared to products from typical refining processes, including higher than expected aromatic contents and/or densities. The combination of higher aromaticity and high density presents some challenges in making a LSFO or ULSFO. The high density can require the use of a low density, and usually low aromatic blend stock to correct the density. The high aromaticity can make the fuel difficult to ignite and combust in an engine, leading to poor combustion and excessive black smoke. In severe cases, the piston and exhaust components may be excessively sooted, causing premature wear. To correct hydroprocessed bottoms is a balance of maintaining enough aromaticity to keep the asphaltenes in solution, and low enough aromaticity for proper ignition and combustion. The use of cetane improver will greatly increase the flexibility in blending by improving the ignition and combustion quality while reducing or minimizing the need to lower the aromaticity of the fuel.

Still another potential advantage can be in the ability to use aromatic blendstocks for pour point correction of a LSFO or ULSFO. Typically the pour point correction blend stocks for improving the pour point of a marine fuel oil correspond to distillate fuels or fractions. Such distillate fuels or fractions can tend to have a low aromatics content, which can contribute to compatibility problems. The ability to improve cetane number using a cetane improver can potentially allow an increased amount of aromatic blend stock to be used for pour point improvement while still achieving an overall target for the cetane number of the resulting marine fuel oil.

Characterizing Solubility and Potential for Asphaltene Precipitation

In order to characterize potential fuel oils with regard to compatibility, one or more methods can be selected to describe the characteristics of a fuel oil with regard to the tendency to form precipitates and/or deposit coke on surfaces. In some aspects, such methods can be directed to the ability of a fuel oil to maintain solubility of asphaltenes and/or the amount of solvency power required to avoid phase separation of asphaltenes.

In this discussion, asphaltenes are defined as corresponding to n-heptane insoluble asphaltenes as can be characterized using ASTM D6560. Such n-heptane insoluble asphaltenes can typically be understood as compounds that are insoluble in n-heptane while being soluble in toluene. It is noted, however, that asphaltenes or asphaltene-type compounds can also be at least partially identified using other solvents. Such alternative solvents can include other $C_3$-$C_7$ alkanes, toluene, or combinations thereof.

Although the asphaltene content of a fuel oil sample can be characterized directly, such as by using ASTM D6560, other methods of characterization can also be used. For example, another method for characterizing a fuel oil sample can be based on a Micro Carbon Residue (MCR) test. In an MCR test, 4 grams of a sample can be put into a weighed glass bulb. The sample in the bulb can then be heated in a bath at 553° C. for 20 minutes. After cooling the bulb can be weighed again and the difference noted. While the MCR test does not provide a direct measure of the asphaltene content, the MCR value is generally believed to be correlated with the tendency of a petroleum fraction to form coke, and therefore may provide an indication of the asphaltene content.

The Bureau of Mines Correlation Index (BMCI) can provide another method for characterizing the properties of a fuel oil (or another petroleum fraction). The BMCI index can provide an indicator of the ability of a fuel oil fraction to maintain solubility of compounds such as asphaltenes. The BMCI index can be calculated based on Equation (1):

$$BMCI = \frac{48640}{VABP} + (473.7 \times d_{60}) - 456.8 \quad (1)$$

In Equation (1), VABP refers to the volume average boiling point in Kelvin of the fraction, which can be determined based on the fractional weight boiling points for distillation of the fraction at 10 vol % intervals from 10 vol % to 90 vol %. The "$d_{60}$" value refers to the density in g/cm$^3$ of the fraction at 60° F. (15.6° C.). While this definition does not directly depend on the nature of the compounds in the fraction, the BMCI index value is believed to provide an indication of the ability of a fuel oil fraction to solvate asphaltenes.

Another method of characterizing the solubility properties of a fuel oil (or other petroleum fraction) can correspond to the toluene equivalence (TE) of a fuel oil, based on the toluene equivalence test as described for example in U.S. Pat. No. 5,871,634, which is incorporated herein by reference with regard to the definition for toluene equivalence, solubility number ($S_{BN}$), and insolubility number ($I_N$).

For the toluene equivalence test, the procedure specified in AMS 79-004 is defined herein as providing the procedure. Generally, a convenient volume ratio of oil to a test liquid mixture can be selected, such as about 2 g of fuel oil (with a density of about 1 g/cm$^3$) to about 10 ml of test liquid mixture. Then various mixtures of the test liquid mixture can be prepared by blending n-heptane and toluene in various known proportions. Each of these can be mixed with the fuel oil at the selected volume ratio of oil to test liquid mixture. A determination can then be made for each oil/test liquid mixture if the asphaltenes are soluble or insoluble. Any convenient method might be used. One possibility can be to observe a drop of the blend of test liquid mixture and oil between a glass slide and a glass cover slip using transmitted light with an optical microscope at a magnification of from 50× to 600×. If the asphaltenes are in solution, few, if any, dark particles will be observed. If the asphaltenes are insoluble, many dark, usually brownish, particles, usually 0.5 to 10 microns in size, will be observed. Another possible method can be to put a drop of the blend of test liquid mixture and oil on a piece of filter paper and let dry. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures can then be ordered according to increasing percent toluene in the test liquid mixture. The desired TE value can be between the minimum percent toluene that dissolves asphaltenes and the maximum percent toluene that precipitates asphaltenes. Depending on the desired level of accuracy, more test liquid mixtures can be prepared with percent toluene amounts in between these limits. The additional test liquid mixtures can be blended with oil at the selected oil to test liquid mixture volume ratio, and determinations can be made if the asphaltenes are soluble or insoluble. The process can be continued until the desired value is determined within the desired accuracy. The final desired TE value can be taken as the mean of the minimum percent toluene that dissolves asphaltenes and the maximum percent toluene that precipitates asphaltenes.

The above test method for the toluene equivalence test can be expanded to allow for determination of a solubility number ($S_{BN}$) and an insolubility number ($I_N$) for a fuel oil sample. If it is desired to determine $S_{BN}$ and/or $I_N$ for a fuel oil sample, the toluene equivalence test described above can be performed to generate a first data point corresponding to a first volume ratio $R_1$ of fuel oil to test liquid at a first percent of toluene $T_1$ in the test liquid at the TE value. After generating the TE value, one option can be to determine a second data point by a similar process but using a different oil to test liquid mixture volume ratio. Alternatively, a percent toluene below that determined for the first datum point can be selected and that test liquid mixture can be added to a known volume of the fuel oil until asphaltenes just begin to precipitate. At that point the volume ratio of oil to test liquid mixture, $R_2$, at the selected percent toluene in the test liquid mixture, $T_2$, can be used the second data point. Since the accuracy of the final numbers can increase at greater distances between the data points, one option for the second test liquid mixture can be to use a test liquid containing 0% toluene or 100% n-heptane. This type of test for generating the second data point can be referred to as the heptane dilution test.

Based on the toluene equivalence test and heptane dilution test (or other test so that $R_1$, $R_2$, $T_1$, and $T_2$ are all defined), the insolubility and solubility numbers for a sample can be calculated based on Equations (2) and (3).

$$I_N = T_2 - \left[\frac{T_2 - T_1}{R_2 - R_1}\right] R_2 \tag{2}$$

$$S_{BN} = I_N[1 + 1/R_2] - T_2/R_2 \tag{3}$$

As noted in U.S. Pat. No. 5,871,634, alternative methods are available for determining the solubility number of a fuel oil that has an insolubility number of zero.

Marine Fuel Oil or Fuel Oil Blend Stock Characteristics

In some aspects, the fuel oils or fuel oil blend stocks can have a natural cetane number (such as an estimated cetane number according to IP 541) that is lower than a cetane number for a distillate fuel, such as a cetane number of 5 to 30, or 5 to 25, or 10 to 30. After addition of a cetane improver, the marine fuel oil or fuel oil blend stock (including cetane improver) can have a cetane number of 15 to 35, or 15 to 30, or 20 to 35, or 20 to 30. For convenience in the discussion below, references to a fuel oil should be understood to also refer to blend stocks suitable for making a fuel oil, unless otherwise noted.

For other properties, marine fuel oils or fuel blending stocks described herein can correspond to fractions or (blends of fractions) that have various characteristics. For example, in some aspects a fuel oil can have a sulfur content of about 0.50 wt % or less, or about 0.30 wt % or less, or about 0.10 wt %, such as down to about 0.050 wt % or possibly still lower. Additionally or alternately, the fuel oil may have a sulfur content of about 0.050 wt % to about 0.50 wt %, or about 0.10 wt % to about 0.50 wt %, or about 0.050 wt % to about 0.30 wt %, or about 0.050 wt % to about 0.10 wt %. In such aspects, the fuel oil may be suitable as an ULSFO and/or a LSFO, or as a blendstock for forming an ULSFO and/or a LSFO. In other aspects, the fuel oil can have a higher sulfur content, such as a sulfur content of 0.05 wt % to 3.5 wt %, or 0.1 wt % to 3.5 wt %, or 0.1 wt % to 2.0 wt %, or 0.1 wt % to 1.0 wt %.

In some aspects, a fuel oil with a lower n-paraffin content can provide a reduced or minimized risk for wax precipitation and filter blocking in fuel systems. For example, the fuel oil can have an n-paraffin content of about 20 wt % or less, or about 10 wt % or less, or about 5.0 wt % or less, or about 1.0 wt % or less, such as down to about 0.1 wt % or possibly still lower.

Additionally or alternatively, the fuel oil can include a sufficiently high amount of aromatics, including alkyl-functionalized derivatives thereof, to provide increased compatibility with various residual fuel oils. For example, the fuel oil can include 40 wt % or more of aromatics, or 60 wt % or more, or 80 wt % or more, such as up to 99 wt % or possibly still higher. Such aromatics can include those having one or more hydrocarbon substituents, such as from 1 to 6 or 1 to 4 or 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different.

In some aspects, the fuel oil can contain compounds having one or more aromatic cores. For example, in some aspects the fuel oil can include 30 wt % or more of molecules having at least one aromatic core, or 50 wt % or more, or 70 wt % or more, such as up to 90 wt % or possibly still higher.

The second hydroprocessed product will now be described in terms of moieties falling into distinct ring classes as described above as determined by two-dimensional gas chromatography (2D GC). Preferred, among each ring class described, are those moieties comprising at least one aromatic core.

Additionally or alternatively, the fuel oil can have an asphaltenes content of about 1.0 wt % to about 20 wt %, or about 0.5 wt % to about 15 wt %, or about 2.0 wt % to about 10 wt %. Additionally or alternately, the fuel oil can have a micro carbon residue content of 2.0 wt % or more, or 3.0 wt % or more, such as up to 8.0 wt % or possibly still higher. Additionally or alternately, the fuel oil can have a boiling point distribution of about 145° C. to about 760° C., as measured according to ASTM D6352. Additionally or alternately, the fuel oil can have a pour point, as measured according to ASTM D5949, of about −30° C. to about 30° C., or about −30° C. to about 10.0° C., or about −30° C. to about 0.0° C., or about −20° C. to about 0.0° C. Additionally or alternately, the fuel oil can have a kinematic viscosity at 50° C. (KV50), as measured according to ASTM D7042, from about 15 cSt to about 1000 cSt, or about 100 cSt to about 800 cSt, or about 200 cSt to about 800 cSt. Additionally or alternately, the fuel oil can have a kinematic viscosity at 100° C. of at least 4 cSt, such as 4 cSt to 500 cSt.

In various aspects, the fuel oil can further have one or more of the following:

(i) a Bureau of Mines Correlation Index (BMCI) of about 50 or more, or about 60 or more, or about 80 or more, or about 100 or more, or about 120 or more, such as up to about 200 or possibly still higher;

(ii) a solubility number ($S_{BN}$) of about 60 or more, or about 80 or more, or about 100 or more, or about 120 or more, or about 150 or more, such as up to about 250 or possibly still higher;

(iii) an insolubility number ($I_N$) of 30 or more, or 40 or more, or 50 or more, such as up to about 100 or possibly still higher;

(iv) a net energy content of about 30 MJ/kg or more, or about 35 MJ/kg or more, or about 42 MJ/kg or more;

(v) a density at 15° C., as measured according to ASTM D4052, of about 0.90 g/cm$^3$ to about 1.10 g/cm$^3$, or about 0.95 g/cm$^3$ to about 1.10 g/cm$^3$, or about 0.99 g/cm$^3$ to about 1.10 g/cm$^3$, or about 1.02 g/cm$^3$ to about 1.10 g/cm$^3$; and (vi) a calculated carbon aromaticity index (CCAI) of 820 or more, or 850 or more, or 870 or more.

Any suitable fuel stream may be used to form a blend corresponding to the marine fuel oil (or marine fuel oil blendstock). Non-limiting examples of suitable fuel streams include a low sulfur diesel, an ultra low sulfur diesel, a low sulfur gas oil, an ultra low sulfur gas oil, a low sulfur kerosene, an ultra low sulfur kerosene, a hydrotreated straight run diesel, a hydrotreated straight run gas oil, a hydrotreated straight run kerosene, a hydrotreated cycle oil, a hydrotreated thermally cracked diesel, a hydrotreated thermally cracked gas oil, a hydrotreated thermally cracked kerosene, a hydrotreated coker diesel, a hydrotreated coker gas oil, a hydrotreated coker kerosene, a hydrocracker diesel, a hydrocracker gas oil, a hydrocracker kerosene, a gas-to-liquid diesel, a gas-to-liquid kerosene, a hydrotreated renewable fat or oil such as tall oil or vegetable oil, fatty acid methyl esters, a non-hydrotreated straight-run diesel, a non-hydrotreated straight-run kerosene, a non-hydrotreated straight-run gas oil, a distillate derived from low sulfur crude slates, a gas-to-liquid wax, gas-to-liquid hydrocarbons, a non-hydrotreated cycle oil, a non-hydrotreated fluid catalytic cracking slurry oil, a non-hydrotreated pyrolysis gas oil, a non-hydrotreated cracked light gas oil, a non-hydrotreated cracked heavy gas oil, a non-hydrotreated pyrolysis light gas oil, a non-hydrotreated pyrolysis heavy gas oil, a non-hydrotreated thermally cracked residue, a non-hydrotreated thermally cracked heavy distillate, a non-hydrotreated coker heavy distillates, a non-hydrotreated vacuum gas oil, a non-hydrotreated coker diesel, a non-hydrotreated coker gasoil, a non-hydrotreated coker vacuum gas oil, a non-hydrotreated thermally cracked vacuum gas oil, a non-hydrotreated thermally cracked diesel, a non-hydrotreated thermally cracked gas oil, a Group 1 slack wax, a lube oil aromatic extracts, a deasphalted oil, an atmospheric tower bottoms, a vacuum tower bottoms, a steam cracker tar, a residue material derived from low sulfur crude slates, an ultra low sulfur fuel oil (ULSFO), a low sulfur fuel oil (LSFO), regular sulfur fuel oil (RSFO), marine fuel oil, a hydrotreated residue material (e.g., residues from crude distillation), a hydrotreated fluid catalytic cracking slurry oil, and a combination thereof. In particular, the fuel stream may be a hydrotreated gas oil, a LSFO, a ULSFO and/or a marine fuel oil.

Example 1—Feedstocks for Demonstrating Benefit of Cetane Improver

In order to demonstrate the benefits of use of a cetane improver with a fuel oil having a cetane number of 30 or less, fuel oil blends were formed using a heavy aromatic feedstock and a distillate feedstock. The first blend corresponded to 60 vol % of the heavy aromatic feedstock and 40 vol % of the distillate feedstock, while the second blend corresponded to a 50 vol %/50 vol % blend.

Table 1 shows the composition and properties of the heavy aromatic feedstock. In Table 1, it is noted that the kinematic viscosity at 50° C. is calculated based on the kinematic viscosities at 60° C. and 100° C. The asphaltenes content is estimated based on the micro carbon residue. An estimated cetane number is not provided because the heavy aromatic feedstock would have a relatively low value, indicative of poor combustion properties. (In some instances, a similar type of aromatic feedstock may not be able to combust under typical test conditions for determining a cetane number.) The net energy content is estimated based on ISO 8217, Annex E, with an assumption of 0.10 wt % water content and 0.01 wt % ash. It is noted that the 2-D gas chromatograph analysis is only effective for components with a distillation point of 566° C. or less. Thus, the compositional data presented in the tables that was based on 2-D gas chromatography corresponds to the 566° C.—portion of the composition.

TABLE 1

| Heavy Aromatic Feedstock | | | |
|---|---|---|---|
| Characteristic | Method | Unit | Result |
| Aromatic Feedstock | | | |
| Kinematic Viscosity @ 100° C. | D7042 | cSt | 24.829 |
| Kinematic Viscosity @ 60° C. | D7042 | cSt | 284.56 |
| Kinematic Viscosity @ 50° C. | Calculated | cSt | 709.8 |
| Density at 15° C. | D4052 | g/cm$^3$ | 1.0615 |
| Solubility number | AMS 99-011 | — | 196 |
| Insolubility number | AMS 99-011 | — | 93 |
| BMCI | Calculated | — | 118.4 |
| Total sediment aged | IS010307-2 | mass % | <0.01 |
| Asphaltenes | D6560 (estimated from carbon residue) | wt % | 5.4 |
| CCAI | Calculated | — | 917 |
| Micro Carbon Residue | D4530 | mass % | 8.08 |
| Pour Point | D5949 | ° C. | −36 |
| Energy content (net) | Calculated | MJ/kg | 40.1 |
| Composition | | | |
| Sulfur | D2622 | mass % | 0.122 |
| Carbon | D5291 | mass % | 90.6 |
| Hydrogen | D5291 | mass % | 8.66 |
| 2D Gas | | | |
| Paraffins | Chromatograph | wt % | 0.11 |
| Naphthene-1 ring | 2D Gas Chromatograph | wt % | 0.13 |
| Naphthene-2 ring | 2D Gas Chromatograph | wt % | 0.37 |
| Total naphthenes | Calculated | wt % | 0.50 |
| Aromatics-1 ring | 2D Gas Chromatograph | wt % | 8.29 |

TABLE 1-continued

| Heavy Aromatic Feedstock | | | |
|---|---|---|---|
| Characteristic | Method | Unit | Result |
| Aromatics-multi-ring | 2D Gas Chromatograph | wt % | 91.11 |
| Total aromatics | Calculated | wt % | 99.40 |
| Distillation | | | |
| T10 | D7169 | ° C. | 302 |
| T50 | D7169 | ° C. | 403 |
| T90 | D7169 | ° C. | 602 |

Table 2 shows the composition and properties of the distillate flux that was combined with the heavy aromatic feed to form the fuel oil blends.

TABLE 2

| Distillate Flux Properties | | | |
|---|---|---|---|
| Characteristic | Method | Unit | Result |
| Kinematic Viscosity @ 50° C. | D445 | cSt | 4.2765 |
| Density at 15° C. | D4052 | g/cm$^3$ | 0.8548 |
| Solubility number | AMS 99-011 | — | 30 |
| Insolubility number | AMS 99-011 | — | 0 |
| BMCI | Calculated | — | 29.9 |
| Asphaltenes | D6560 (estimated from carbon residue) | wt % | 0.0 |
| CCAI | Calculated | — | 795 |
| Estimated cetane number | IP541 | — | 63 |
| Micro Carbon Residue | D4530 | mass % | <0.001 |
| Flash Point | D6450 | ° C. | 91.8 |
| Pour Point | D5950 | ° C. | 9 |
| Energy content (net) | Calculated | MJ/kg | 42.7 |
| Composition | | | |
| Sulfur | D2622 | mass % | 0.0526 |
| Carbon | D5291 | mass % | 77.2 |
| Hydrogen | D5291 | mass % | 11.8 |
| Nitrogen | D5291 | mass % | <0.10 |
| N-Paraffins | 2D Gas Chromatograph | mass % | 17.02 |
| Iso-Paraffins | 2D Gas Chromatograph | mass % | 17.69 |
| Naphthenes | 2D Gas Chromatograph | mass % | 26.86 |
| Aromatics | 2D Gas Chromatograph | mass % | 36.84 |
| Distillation | | | |
| T10 | D6352 | ° C. | 229 |
| T50 | D6352 | ° C. | 325 |
| T90 | D6352 | ° C. | 401 |

Table 3 shows the composition and properties for a blend of 60 vol % heavy aromatic feedstock with 40 vol % of distillate flux. This blend is referred to below as Blend 1.

TABLE 3

| Properties of 60 vol % Heavy Aromatic Feedstock with 40 vol % Distillate Flux (Blend 1) | | | |
|---|---|---|---|
| Characteristic | Method | Unit | Result |
| Kinematic Viscosity @ 50° C. | D445 | cSt | 30.499 |
| Density at 15° C. | B3491 | g/cm$^3$ | 0.9807 |
| Solubility number | AMS 99-011 | — | 123 |
| Insolubility number | AMS 99-011 | — | 90 |
| BMCI | Calculated | — | 84 |
| Total sediment aged | ISO10307-2 | mass % | 0.03 |
| Asphaltenes | D6560 | wt % | 3.73 |
| CCAI | Calculated | — | 875 |
| Estimated cetane number | IP541 | — | 15.1 |
| Micro Carbon Residue | D4530 | mass % | 5.59 |
| Flash Point | D6450 | ° C. | 108 |

TABLE 3-continued

| Properties of 60 vol % Heavy Aromatic Feedstock with 40 vol % Distillate Flux (Blend 1) | | | |
|---|---|---|---|
| Characteristic | Method | Unit | Result |
| Pour Point | D5950 | ° C. | −33 |
| Energy content (net) | Calculated | MJ/kg | 41.3 |
| | Calculated | BTU/gal | 145193 |
| Composition | | | |
| Sulfur | D2622 | mass % | 0.0987 |
| Carbon | D5291 | mass % | 89.2 |
| Hydrogen | D5291 | mass % | 10.2 |
| Nitrogen | D5291 | mass % | <0.10 |
| Distillation | | | |
| T0.5 | D6352 | ° C. | 164 |
| T5 | D6352 | ° C. | 239 |
| T10 | D6352 | ° C. | 271 |
| T20 | D6352 | ° C. | 305 |
| T30 | D6352 | ° C. | 328 |
| T40 | D6352 | ° C. | 348 |
| T50 | D6352 | ° C. | 368 |
| T60 | D6352 | ° C. | 393 |
| T70 | D6352 | ° C. | 424 |
| T80 | D6352 | ° C. | 477 |
| T90 | D6352 | ° C. | 563 |
| T95 | D6352 | ° C. | 628 |
| T99.5 | D6352 | ° C. | 729 |

Table 4 shows the properties of the blend of 50 vol % of the heavy aromatic feedstock and 50 vol % of the distillate flux. This blend is referred to below as Blend 2.

TABLE 4

| Properties of 50 vol % Heavy Aromatic Feedstock with 50 vol % Distillate Flux (Blend 2) | | | |
|---|---|---|---|
| Kinematic Viscosity @ 50° C. | Calculated | cSt | 19.2 |
| Kinematic Viscosity @ 100° C. | D7042 | cSt | 4.4454 |
| Kinematic Viscosity @ 40° C. | D7042 | cSt | 29.703 |
| Density at 15° C. | D4052 | g/cm$^3$ | 0.9600 |
| BMCI | Calculated | — | 75.4 |
| Total sediment aged | ISO10307-2 | mass % | 0.05 |
| Asphaltenes | D6560 | wt % | 3.1 |
| CCAI | Calculated | — | 858 |
| Estimated cetane number | IP541 | — | 25.4 |
| Micro Carbon Residue | D4530 | mass % | 4.58 |
| Flash Point | D6450 | ° C. | 108.7 |
| Pour Point | D5950 | ° C. | −36 |
| Energy content (net) | Calculated | MJ/kg | 41.6 |
| Sulfur | D2622 | mass % | 0.0932 |
| Carbon | D5291 | mass % | 89.1 |
| Hydrogen | D5291 | mass % | 10.6 |
| T5 | D6352 | ° C. | 223 |
| T10 | D6352 | ° C. | 259 |
| T20 | D6352 | ° C. | 296 |
| T30 | D6352 | ° C. | 319 |
| T40 | D6352 | ° C. | 339 |
| T50 | D6352 | ° C. | 358 |
| T60 | D6352 | ° C. | 381 |
| T70 | D6352 | ° C. | 409 |

TABLE 4-continued

| Properties of 50 vol % Heavy Aromatic Feedstock with 50 vol % Distillate Flux (Blend 2) | | | |
|---|---|---|---|
| T80 | D6352 | ° C. | 453 |
| T90 | D6352 | ° C. | 541 |
| T95 | D6352 | ° C. | 612 |
| T99.5 | D6352 | ° C. | 723 |

Example 2—Characterization of Fuel Oil Properties

The estimated cetane numbers shown in Tables 1-4 were determined using a constant volume combustion chamber (CVCC) according to the method in IP 541/06. This method allows for measurement of ignition and combustion properties of a fuel under specific test conditions. Annex F describes how to calculate an estimated cetane number based on the measured ignition and combustion properties. Specifically, the estimated cetane number can be calculated from the ignition parameter Main Combustion Delay (MCD). A higher estimated cetane number corresponds to a shorter MCD, which corresponds to better ignition and combustion quality. The estimated cetane number parameter is a measure of ignition quality derived from the cetane scale used to quantify the ignition characteristics of distillate fuels.

Figure 4:
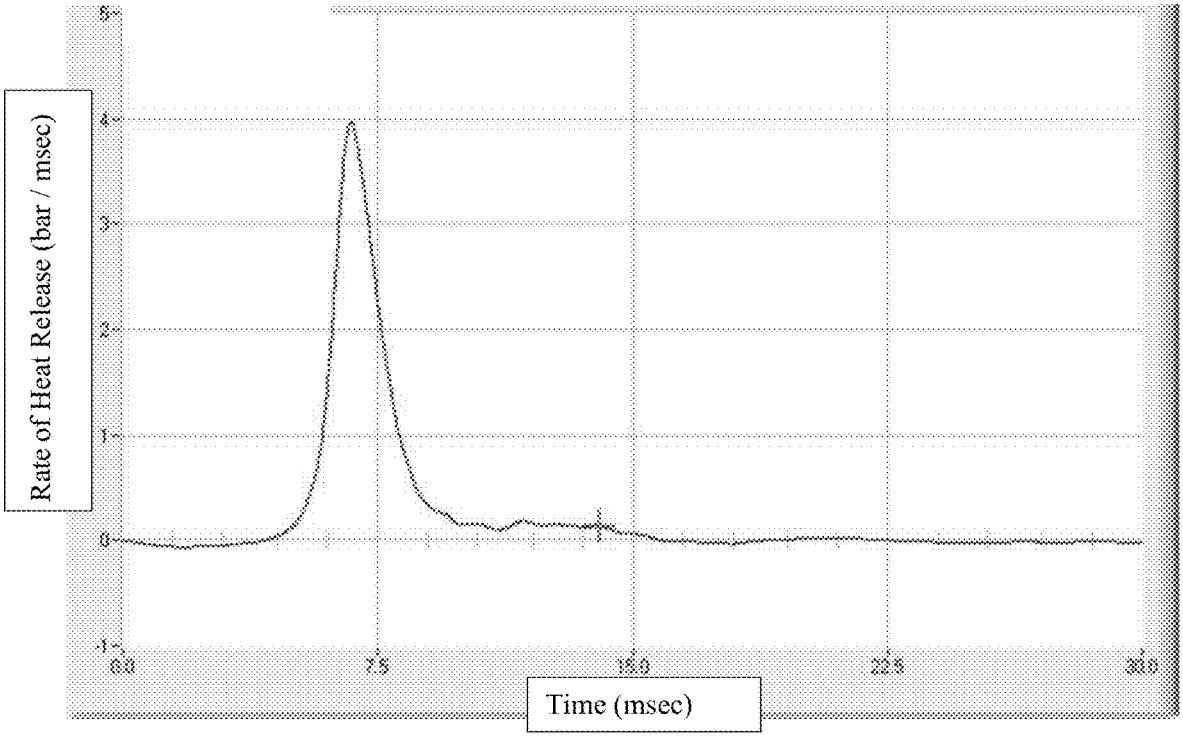
FIG. 4 shows a rate of heat release curve for a different potential fuel oil or fuel oil blend component that does not contain a cetane improver.

FIG. 1 shows the heat release curve used to determine the estimated cetane number of Blend 1, while FIG. 4 shows the heat release curve of Blend 2. The heat release curves clearly show the different combustion characteristics of the two blends. In FIG. 1, the start of combustion for Blend 1 appears to be delayed until well after 5.0 msec. The peak of heat release is after 7.5 msec, and the peak shape is somewhat broad. This is in contrast to the features shown in FIG. 4. For Blend 2, combustion appears to start at 4.5 msec. The peak of heat release is prior to 7.5 msec, and the peak shape is narrower, indicating that combustion occurs in a shorter period of time. The characteristics shown in FIGS. 1 and 4 correlate with the estimated cetane numbers calculated for Blend 1 and Blend 2. As shown in Table 3, the estimated cetane number for Blend 1 is 15.4, while Table 4 shows that the estimated number for Blend 2 is 25.4.

Figure 2:
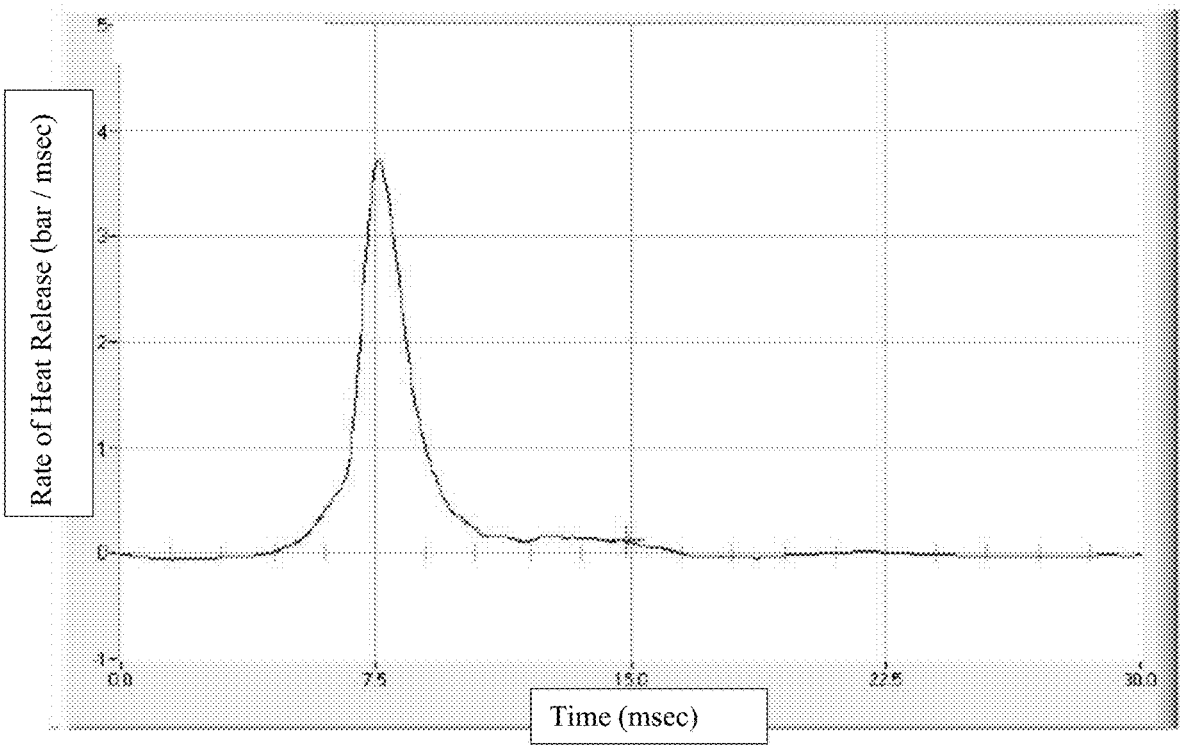
FIG. 2 shows a rate of heat release curve for a potential fuel oil or fuel oil blend component similar to FIG. 1 but with 500 vppm of a cetane improver.

Additional heat release curves were also obtained for modified versions of Blend 1 that included cetane improver. FIG. 2 shows the heat release curve for Blend 1 with 500 vppm of 2-ethylhexyl nitrate added as a cetane improver. As shown in FIG. 2, addition of the cetane improver both shifted the start of heat release to an earlier time and narrowed the peak width/increased the peak height. This indicates improved ignition and combustion characteristics. The estimated cetane number for Blend 1 with the 500 vppm of cetane improver is 20.6, a 36% increase relative to the natural estimated cetane number of Blend 1. This increase of 5.2 in the estimated cetane number is unexpected based on the low natural estimated cetane number of Blend 1. Based on conventional understanding, a minimal increase of 3 (or likely less) in the cetane number would be expected due to the extremely low natural cetane number of 15.4 for Blend 1.

Figure 3:
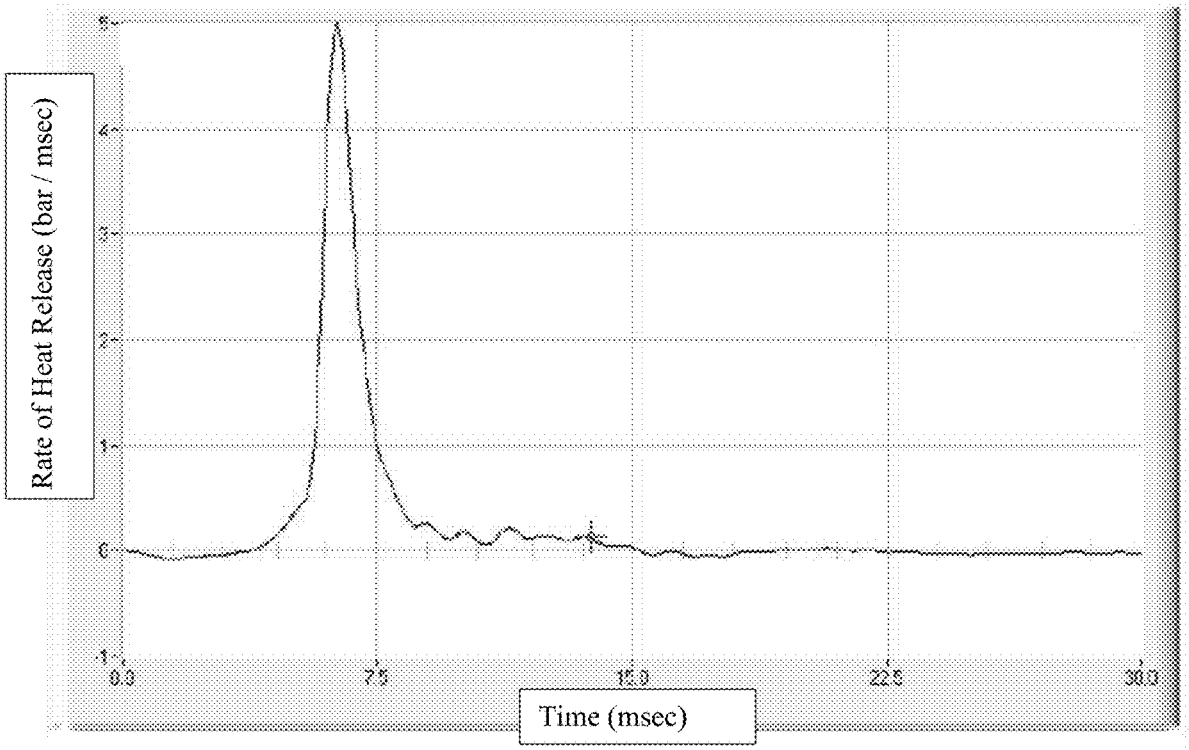
FIG. 3 shows a rate of heat release curve for a potential fuel oil or fuel oil blend component similar to FIG. 1 but with 5000 vppm of a cetane improver.

FIG. 3 shows a still more unexpected heat release curve. FIG. 3 corresponds to a heat release curve for addition of 5000 vppm of 2-ethylhexyl nitrate to Blend 1. This results in an 87% increase in the estimated cetane number to 28.2. The difference in estimated cetane number between Blend 1 and the mixture of Blend 1 with 5000 vppm of cetane improver is 12.8. This level of increase in cetane number would be unexpected for a distillate fuel having a natural cetane number of 40 or more, and therefore is even more unexpected based on addition of cetane improver to a fuel oil with a natural cetane number of 15.4.

The data shown in FIGS. 1 to 4 is summarized in Table 5 below.

TABLE 5

Summary of Heat Release Curves

| Marine fuel | Estimated Cetane Number (IP 541) | Main Combustion Delay (ms) | Main Combustion Period (ms) | Accumulated Rate of Heat Release (arbitrary unit) |
|---|---|---|---|---|
| Blend 1 | 15.1 | 8.09 | 5.24 | 7.11 |
| Blend 2 | 25.4 | 6.28 | 3.50 | 7.28 |
| Distillate Flux | 63 | 3.08 | 5.79 | 7.92 |
| Blend 1 with 500 vppm of 2-EHN | 20.6 | 7.02 | 3.43 | 7.16 |
| Blend 1 with 5000 vppm of 2-EHN | 28.2 | 5.91 | 3.25 | 7.20 |

As shown in Table 5, Blend 1 with 5000 vppm of cetane improver has an estimated cetane number that is greater than Blend 2. In other words, addition of the cetane improver resulted in more improvement in combustion characteristics than increasing the volume percentage of distillate fuel in the blend by 10 vol %. This can allow a fuel oil of similar cetane number to be made while reducing or minimizing the loss of aromatics content and/or other properties in a fuel oil blend. For example, as shown in Tables 3 and 4, Blend 1 has a BMCI value of roughly 85 while Blend 2 has a BMCI value of roughly 75. This indicates a substantial change in the solubility properties between Blend 1 and Blend 2. The addition of the cetane improver to Blend 1 can allow substitution of Blend 1 (with cetane improver) for Blend 2 when forming a marine fuel oil, thus reducing or minimizing the risk of incompatibility.

Additional Embodiments

Embodiment 1. A marine fuel oil composition comprising an estimated cetane number (according to IP541) of 35 or less and at least 200 vppm of a cetane improver relative to a volume of the marine fuel oil composition, the marine fuel oil composition further comprising at least two (or at least three, or all) of the following properties: a) a BMCI of 50 or more (or 60 or more, or 80 or more, or 100 or more); b) a CCAI of 820 or more (or 850 or more, or 870 or more); c) a density of 0.90 g/cm$^3$ or more at 15° C. (or 0.95 g/cm$^3$ or more, or 0.99 g/cm$^3$ or more, or 1.02 g/cm$^3$ or more); d) a T90 distillation point of at least 450° C.

Embodiment 2. The marine fuel oil composition of Embodiment 1, wherein the marine fuel oil composition comprises an estimated cetane number (based on IP541) of 30 or less.

Embodiment 3. The marine fuel oil composition of any of the above embodiments, wherein the marine fuel oil composition comprises at least three of a), b), c) and d); or wherein the marine fuel oil composition comprises a), b), c), and d).

Embodiment 4. A method for forming a marine fuel oil composition comprising adding at least 200 vppm of a cetane improver to a fuel composition comprising an estimated cetane number (based on IP541) of less than 30 (or less than 25), the fuel composition further comprising at least two (or at least three, or all) of the following properties: a) a BMCI of 50 or more (or 60 or more, or 80 or more, or 100 or more); b) a CCAI of 820 or more (or 850 or more, or 870 or more); c) a density of 0.90 g/cm$^3$ or more at 15° C. (or 0.95 g/cm$^3$ or more, or 0.99 g/cm$^3$ or more, or 1.02 g/cm$^3$ or more); d) a T90 distillation point of at least 450° C.

Embodiment 5. The method of Embodiment 4, wherein the marine fuel oil composition comprises an estimated cetane number (based on IP541) of 35 or less (or 30 or less).

Embodiment 6. The method of Embodiment 4 or 5, wherein the fuel composition comprises at least three of a), b), c) and d); or wherein the fuel composition comprises a), b), c), and d).

Embodiment 7. The marine fuel oil composition or method of any of the above embodiments, wherein the marine fuel oil composition comprises a sulfur content of 0.5 wt % or less (or 0.1 wt % or less).

Embodiment 8. The marine fuel oil composition or method of any of the above embodiments, wherein the marine fuel oil composition comprises a sulfur content of 0.05 wt % or more.

Embodiment 9. The marine fuel oil composition or method of any of the above embodiments, wherein the marine fuel oil composition comprises a KV50 of at least 15 cSt, a KV100 of at least 4 cSt, or a combination thereof.

Embodiment 10. The marine fuel oil composition or method of any of the above embodiments, wherein the marine fuel oil composition comprises an insolubility number of 30 or more (or 40 or more, or 50 or more); or wherein the marine fuel oil composition comprises a solubility number of 60 or more (or 80 or more, or 100 or more); or a combination thereof.

Embodiment 11. The marine fuel oil composition or method of any of the above embodiments, wherein the marine fuel oil composition comprises at least 500 vppm of the cetane improver (or at least 1000 vppm, or at least 2000 vppm).

Embodiment 12. The marine fuel oil composition or method of any of the above embodiments, wherein the cetane improver comprises an organic nitrate, a peroxide, or a combination thereof.

Embodiment 13. The marine fuel oil composition or method of any of the above embodiments, wherein the marine fuel oil composition comprises a micro carbon residue content of 2.0 wt % or more (or 3.0 wt % or more); or wherein the marine fuel oil composition comprises 1.0 wt % of asphaltenes or more (or 2.0 wt % or more); or a combination thereof.

Embodiment 14. The marine fuel oil composition or method of any of the above embodiments, wherein the marine fuel oil composition comprises 40 wt % or more of aromatics (or 60 wt % or more, or 80 wt % or more); or wherein the marine fuel oil composition comprises 20 wt % or less of n-paraffins (or 10 wt % or less); or a combination thereof.

Embodiment 15. The marine fuel oil composition or method of any of the above embodiments, wherein the marine fuel oil composition comprises 200 vppm to 10,000 vppm of the cetane improver, or 500 vppm to 5000 vppm, or 1000 vppm to 10,000 vppm, or 1000 vppm to 5000 vppm, or 2000 vppm to 5000 vppm.

Embodiment 16. A marine fuel oil composition formed according to the method of any of Embodiments 4-15.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

The invention claimed is:

1. A marine residual fuel oil composition comprising an estimated cetane number (according to IP541) of 35 or less, a micro carbon residue content of 3.0 wt % or more and at least 200 vppm of a cetane improver relative to a volume of the marine fuel oil composition, wherein the cetane improver comprises an organic nitrate, a peroxide, or a combination thereof, the marine fuel oil composition further comprising at least two (or at least three, or all) of the following properties:

a) a BMCI of 50 or more;

b) a CCAI of 820 or more;

c) a density of 0.90 g/cm$^3$ or more at 15° C.;

d) a T90 distillation point of at least 450° C.

2. The marine residual fuel oil composition of claim 1, wherein the marine fuel oil composition comprises an estimated cetane number (based on IP541) of 30 or less.

3. The marine residual fuel oil composition of claim 1, wherein the marine fuel oil composition comprises at least three of a), b), c) and d); or wherein the marine fuel oil composition comprises a), b), c), and d).

4. The marine residual fuel oil composition of claim 1, wherein the marine fuel oil composition comprises a sulfur content of 0.5 wt % or less.

5. The marine residual fuel oil composition of claim 1, wherein the marine fuel oil composition comprises a sulfur content of 0.05 wt % or more.

6. The marine residual fuel oil composition of claim 1, wherein the marine fuel oil composition comprises a kinematic viscosity at 50° C. of at least 15 cSt, a kinematic viscosity at 100° C. of at least 4 cSt, or a combination thereof.

7. The marine residual fuel oil composition of claim 1, wherein the marine fuel oil composition comprises an insolubility number of 30 or more; or wherein the marine fuel oil composition comprises a solubility number of 60 or more; or a combination thereof.

8. The marine residual fuel oil composition of claim 1, wherein the marine fuel oil composition comprises at least 500 vppm of the cetane improver.

9. The marine residual fuel oil composition of claim 1, wherein the marine fuel oil composition comprises at least 1000 vppm of the cetane improver.

10. The marine residual fuel oil composition of claim 1, wherein the marine fuel oil composition comprises at least 2000 vppm of the cetane improver.

11. The marine residual fuel oil composition of claim 1, wherein the marine fuel oil composition comprises 2.0 wt % of asphaltenes or more.

12. The marine residual fuel oil composition of claim 1, wherein the marine fuel oil composition comprises 40 wt % or more of aromatics; or wherein the marine fuel oil composition comprises 20 wt % or less of n-paraffins; or a combination thereof.

13. A method for forming a marine residual fuel oil composition comprising adding at least 200 vppm of a cetane improver to a fuel composition comprising an estimated cetane number (based on IP541) of less than 30, and a micro carbon residue content of 3.0 wt % or more, wherein the cetane improver comprises an organic nitrate, a peroxide, or a combination thereof, the fuel composition further comprising at least two of the following properties:

a) a BMCI of 50 or more;

b) a CCAI of 820 or more;

c) a density of 0.90 g/cm$^3$ or more at 15° C.;

d) a T90 distillation point of at least 450° C.

14. The method of claim 13, wherein the marine residual fuel oil composition comprises an estimated cetane number (based on IP541) of 35 or less.

15. The method of claim 13, wherein the marine residual fuel composition comprises at least three of a), b), c) and d); or wherein the fuel composition comprises a), b), c), and d).

16. The method of claim 13, wherein the marine residual fuel oil composition comprises a sulfur content of 0.5 wt % or less; or wherein the fuel composition comprises a sulfur content of 0.05 wt % or more; or a combination thereof.

17. The method of claim 13, wherein the marine residual fuel oil composition comprises a kinematic viscosity at 50° C. of at least 15 cSt, a kinematic viscosity at 100° C. of at least 4 cSt, or a combination thereof.

18. The marine residual fuel oil composition of claim 1 or the method of claim 13, wherein the marine residual fuel oil composition comprises at least 500 vppm of the cetane improver.

19. The marine residual fuel oil composition of claim 1 or the method of claim 13, wherein the marine residual fuel oil composition comprises 40 wt % or more of aromatics; or wherein the marine residual fuel oil composition comprises 20 wt % or less of n-paraffins; or a combination thereof.

* * * * *